US007614460B2

(12) United States Patent
Henriksson et al.

(10) Patent No.: US 7,614,460 B2
(45) Date of Patent: Nov. 10, 2009

(54) IMPACT TOOL WITH A MOVABLY SUPPORTED IMPACT MECHANISM

(75) Inventors: Stig Roland Henriksson, Nacka (SE); Olof Bertil Sigurd Östenssn, Kalmar (SE)

(73) Assignee: Atlas Copco Construction Tools AB, Nacka (SE)

( * ) Notice: Subject to any disclaimer, the term of this patent is extended or adjusted under 35 U.S.C. 154(b) by 26 days.

(21) Appl. No.: 11/631,826

(22) PCT Filed: Jul. 5, 2005

(86) PCT No.: PCT/SE2005/001119

§ 371 (c)(1),
(2), (4) Date: Aug. 23, 2007

(87) PCT Pub. No.: WO2006/004547

PCT Pub. Date: Jan. 12, 2006

(65) Prior Publication Data

US 2008/0164043 A1 Jul. 10, 2008

(30) Foreign Application Priority Data

Jul. 5, 2004 (SE) ..... 0401728

(51) Int. Cl.
*B25D 17/24* (2006.01)

(52) U.S. Cl. ..... 173/109; 173/112; 173/113; 173/200; 173/210; 173/211

(58) Field of Classification Search ..... 173/109, 173/112, 113, 200, 210, 211
See application file for complete search history.

(56) References Cited

U.S. PATENT DOCUMENTS 2,899,934 A 8/1959 Salengro (Continued)

FOREIGN PATENT DOCUMENTS

CN 1502451 A 6/2004

(Continued)

OTHER PUBLICATIONS

First Chinese Office Action dated Jul. 25, 2008, and English translation thereof, issued in counterpart Chinese Application No. 2005800253733.

(Continued)

*Primary Examiner*—Brian D Nash
(74) *Attorney, Agent, or Firm*—Frishauf, Holtz, Goodman & Chick, P.C.

(57) ABSTRACT

A portable power tool includes a housing, and an impact mechanism movably supported in the housing and having a front opening for receiving a working implement and a hammer piston for delivering hammer blows to the working implement. The impact mechanism is supported in the housing by a pivot device in a point located between the forward and rear ends of the impact mechanism and allowing longitudinal and pivotal movements but preventing in the support point radial and rotational movements of the impact mechanism relative to the housing. A resilient device is located at a distance from the pivot device and is arranged to bias the impact mechanism to a neutral position relative to the housing and to absorb vibration movements of the impact mechanism to protect the housing against such vibration movements.

20 Claims, 2 Drawing Sheets

U.S. PATENT DOCUMENTS

| | | | | |
|---|---|---|---|---|
| 4,014,392 | A * | 3/1977 | Ross | 173/118 |
| 4,723,610 | A | 2/1988 | Dummermuth et al. | |
| 4,747,455 | A * | 5/1988 | Cunningham | 173/1 |
| 5,025,870 | A | 6/1991 | Gantner | |
| 5,213,167 | A | 5/1993 | Best et al. | |
| 5,921,327 | A * | 7/1999 | Henriksson et al. | 173/210 |
| 6,763,897 | B2 * | 7/2004 | Hanke et al. | 173/210 |
| 7,013,986 | B2 * | 3/2006 | Mikiya et al. | 173/114 |
| 2004/0154813 | A1 | 8/2004 | Daubner et al. | |
| 2006/0144603 | A1 * | 7/2006 | Arich et al. | 173/109 |
| 2007/0068707 | A1 * | 3/2007 | Henriksson et al. | 175/417 |

FOREIGN PATENT DOCUMENTS

| | | |
|---|---|---|
| EP | 1 422 029 A1 | 5/2004 |
| SE | 449830 | 5/1987 |

OTHER PUBLICATIONS

Second Chinese Office Action dated May 22, 2009, and English translation thereof, issued in counterpart Chinese Application No. 2005800253733.

* cited by examiner

IMPACT TOOL WITH A MOVABLY SUPPORTED IMPACT MECHANISM

This application is a U.S. National Phase Application under 35 USC 371 of International Application PCT/SE2005/001119 filed Jul. 5, 2005.

BACKGROUND OF THE INVENTION

The invention relates to a portable impact tool including a housing with at least one handle for manual support of the tool, an impact mechanism movably supported in the housing and having a forward open end for receiving a working implement and a rear end located inside the housing, wherein the impact mechanism is arranged to deliver hammer blows to the working implement attached to the tool.

In impact tools of the above type there has always been a problem to minimize vibrations to which the operator is exposed. A common way to reduce vibration transfer from the impact mechanism to the housing is to arrange the latter longitudinally displaceable relative to the housing and to employ resilient spring elements for absorbing vibrations and conveying feed forces applied on the housing during operation of the tool. However, the vibrations generated in the impact mechanism are not only longitudinally directed but to some extent transverse, and conventional arrangements with a slidable impact mechanism are not effective enough to protect the operator from the exposure to transverse vibration movements. A prior art device of this type is disclosed in for instance U.S. Pat. No. 2,899,934.

An impact tool with an alternative impact mechanism support means is disclosed in U.S. Pat. No. 5,025,870. In this tool the impact mechanism is movably supported in the housing by a pair of parallel links which are pivotal relative to the impact mechanism and the housing via parallel pivot axes. By this arrangement the impact mechanism is movable relative to the housing in a parallel manner to permit longitudinal vibrations to be absorbed. However, there is no freedom provided for the impact mechanism to enable absorption of pivoting movements of the impact mechanism resulting from transverse vibration forces in the working implement.

SUMMARY OF THE INVENTION

The main object of the invention is to provide an improved power tool of the above type comprising a simple yet effective arrangement by which the impact mechanism is supported in the housing in such a way that both longitudinal and pivotal movements of the impact mechanism are absorbed and prevented from being transferred to the housing and operator.

Further objects and advantages of the invention will appear from the following specification and claims.

A preferred embodiment of the invention is below described in detail with reference to the accompanying drawings.

DETAILED DESCRIPTION

Figure 1:
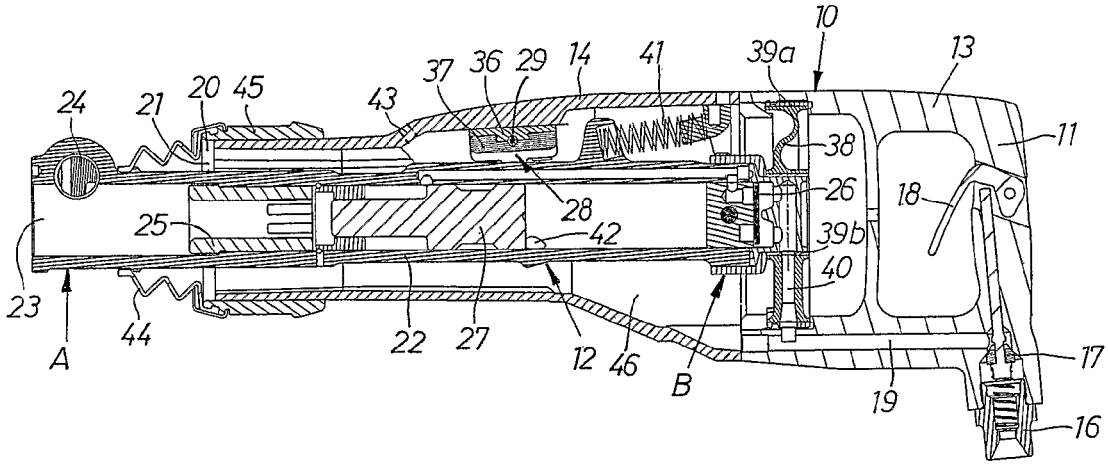
FIG. 1 shows a longitudinal section through a power tool according to one embodiment of the invention.
Figure 2:
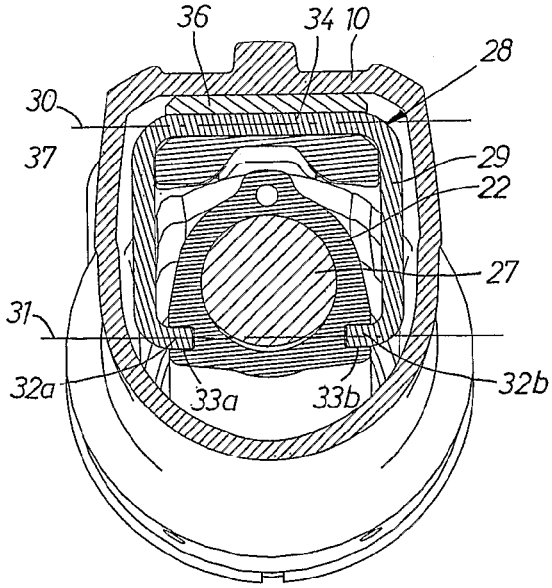
FIG. 2 shows a transverse section through the power tool in FIG. 1.

The impact tool illustrated in FIGS. 1 and 2 comprises a housing 10 with a rear handle 11, and a pneumatic impact mechanism 12 which has a forward end A and a rear end B is movably supported in the housing 10. The housing 10 comprises a rear part 13 made of a metal casting and a forward part 14 made of a somewhat resilient sound damping material like polyurethane. In the rear part 13 of the housing 10 there is located a connection 16 for a pressure air conduit, a throttle valve 17 operated by a lever 18, and a pressure air supply passage 19 communicating with the impact mechanism 12. The housing 10 has a closed rear end and an opening 20 at its forward end, and the forward end A of the impact mechanism 12 is arranged to extend out through the forward end opening 20 to receive the rear end of a working implement, for instance a chisel (not shown). The rear end B of the impact mechanism 12 is located in the closed end of the housing 10. The opening 20 is wide enough to leave a clearance 21 between the housing 10 and the cylinder 22, thereby permitting a certain radial movement of the forward part of the cylinder 22.

The impact mechanism 12 comprises a cylinder 22 with an implement receiving opening 23 and a working implement retaining lock spindle 24 at its forward end A. Inside the cylinder 22 there is a working implement guide sleeve 25. At its rear end B the cylinder 22 has a distribution valve 26 to feed pressure air into the cylinder 22 to drive a hammer piston 27 in a reciprocating manner to accomplish repeated hammer blows on the working implement. The impact mechanism 12 is not described in further detail since it is of a conventional type and does not form a part of the invention. At a position between its forward end and its rear end the cylinder 22 is supported relative to the housing 10 by means of a pivot device 28 including a link 29. See FIG. 2. The link 29 is pivotal relative to the housing 10 and to the cylinder 22 via two parallel axes 30,31, which means that the cylinder 22 is able to be pivoted as well as longitudinally displaced, whereas rotational and radial movements in the support point are substantially prevented. The link 29 is made of a bent wire having its ends 32*a,b* received in lateral openings 33*a,b* in the cylinder 22 extending co-axially with the axis 31. The mid section 34 of the link 29 is pivoted in a resilient block comprising a base member 36 and a cap 37 both secured to the housing 10 by threaded fasteners.

Due to the parallel axes arrangement of the link 29 pivotation of the cylinder 22 is possible in substantially one plane, but due to some weakness in the link 29 itself and the resilient block 36,37 some pivotal movements of the cylinder 22 in other planes would also be possible.

Figure 4:
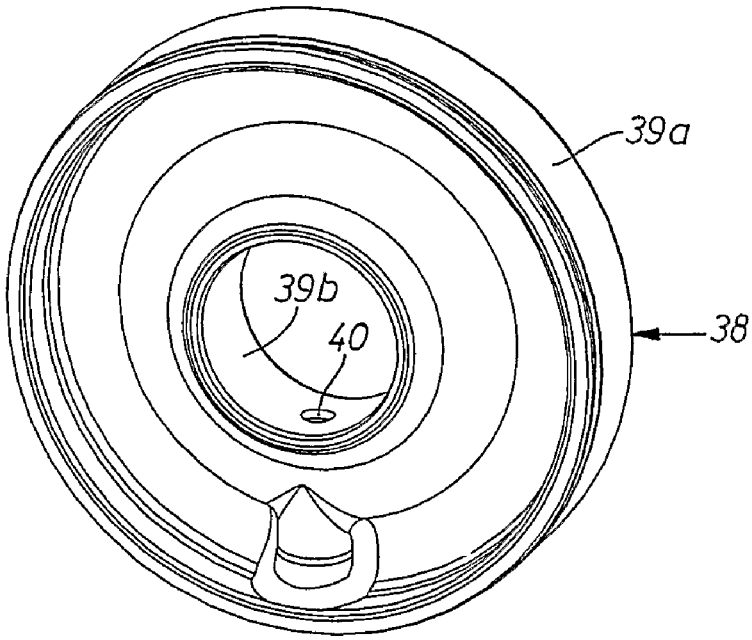
FIG. 4 shows on a larger scale a perspective view of an elastic membrane included in a power tool according to the invention.

In order to bias the cylinder 22 into a neutral position in the housing 10, both lengthwise and sidewise, there is provided an annular resilient membrane 38 is mounted between the rear end of the cylinder 22 and the housing 10 such that an outer periphery 39*a* of the membrane 38 is supported against the housing 10 and an inner periphery 39*b* of the membrane 38 is supported against the cylinder 22. See FIG. 4. This membrane 38 is not only able to bias the cylinder 22 towards a neutral position in the housing 10 but will yield elastically to radial and longitudinal movements of the cylinder 22, thereby absorbing vibration movements of the cylinder 22 and protect the housing 10 and hence the operator from such vibrations. The membrane 38 is also formed with a radially extending air feed passage 40 for communicating pressure air from the air supply passage 19 in the housing 10 to the distribution valve 26 via the inner periphery 39*b* for driving the hammer piston 27 in the cylinder 22.

Moreover, there is provided a coil spring 41 between a the cylinder 22 and the housing 10 for transferring to the cylinder 22 and further to the working implement feed forces applied on the housing 10 via for instance the handle 11. The spring 41 will also absorb vibration movements in cylinder 22.

The cylinder 22 has exhaust openings 42 located inside the housing 10, and the housing 10 is provided with exhaust air outlet openings 43 to duct away exhaust air from the impact mechanism 12 during operation of the tool. In order to prevent exhaust air from leaving the housing 10 through the forward opening 20 there is fitted a bellow 44 bridging the clearance 21 between the cylinder 22 and the housing 10 and permitting radial as well as longitudinal movements of the cylinder 22. Because of the rear closed end of the housing 10 and the bellow 44 at the forward end of the housing 10 there is formed a sound damping chamber 46 inside the housing 10.

At the forward end of the housing 10 there is mounted an external sleeve 45 which has the double function as a grip element for the operator in horizontal working positions. The sleeve 45 is made of a heavy material like steel and is also utilized as a vibration reducing weight.

Figure 3:
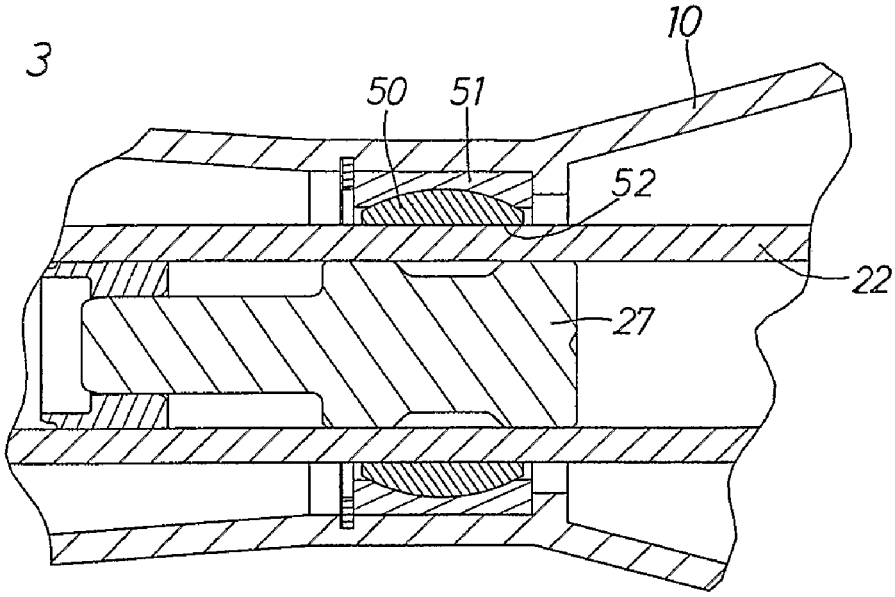
FIG. 3 shows a fractional view of a power tool according to an alternative embodiment of the invention.

It is to be noted that the embodiments of the invention are not limited to the above described examples but can be varied within the scope of the claims. For instance the pivot device 28 could be designed otherwise. In FIG. 3, there is illustrated an alternatively designed pivot device which instead of a link comprises a universal joint with a spherical element 50 pivotally supported in a spherical socket portion 51 retained in the housing in the housing 10. The spherical element 50 has a through opening 52 for slidably guiding the cylinder 22 in a longitudinal direction. In this embodiment of the invention the cylinder 22 is able to pivot in any plane which is favourable in absorbing transverse vibration forces generated in the chisel and the cylinder 22. In this example rotational forces are transferred between the housing 10 and cylinder 22 by the membrane 38.

The invention claimed is:

1. A portable impact power tool comprising:

a housing having at least one handle for manual support of the tool, an impact mechanism movably supported in the housing and having a forward end with an opening for receiving a working implement and a rear end located inside the housing, wherein the impact mechanism is arranged to deliver hammer blows to the working implement, a pivot joint arranged to support the impact mechanism relative to the housing at a point located between the forward end and the rear end of the impact mechanism, said pivot joint allowing longitudinal and pivotal movements but preventing in the support point radial and rotational movements of the impact mechanism relative to the housing, whereby the impact mechanism is supported in the housing such that both longitudinal and pivotal movements of the impact mechanism are absorbed and prevented from being transferred to the housing, and at least one resilient element mounted between the housing and the impact mechanism at a distance from said pivot joint for biasing the impact mechanism towards a neutral position relative to the housing while absorbing vibration movements of the impact mechanism.

2. A power tool according to claim 1, wherein said pivot joint comprises a link which is pivotal relative to the impact mechanism and the housing via two parallel axes extending transversely to a working direction of the impact mechanism.

3. A power tool according to claim 2, wherein said at least one resilient element is located at the rear end of the impact mechanism.

4. A power tool according to claim 2, further comprising a spring arranged between the impact mechanism and the housing to absorb longitudinal vibration movements of the impact mechanism and to transfer to the impact mechanism forwardly directed feeding forces applied on the housing.

5. A power tool according to claim 2, wherein:

the impact mechanism is pneumatically powered and comprises a cylinder and a hammer piston, the housing has a pressure air supply passage, and said at least one resilient element is formed with an air feed passage connecting the pressure air supply passage in the housing to the impact mechanism.

6. A power tool according to claim 5, wherein:

the housing has a closed rear end and an opening at its forward end, the cylinder extends out through said opening leaving an annular clearance between the housing and the cylinder, and a bellows is provided to seal off said clearance and form a closed damping chamber in the housing through which exhaust air from the cylinder passes.

7. A power tool according to claim 1, wherein said pivot joint comprises a universal joint arranged to enable the impact mechanism to pivot in any plane relative to the housing.

8. A power tool according to claim 7, wherein said universal joint comprises a spherical element pivotally supported in a spherical socket portion in the housing, and wherein said spherical element has a through opening in which the impact mechanism is slidably guided.

9. A power tool according to claim 8, wherein said at least one resilient element is located at the rear end of the impact mechanism.

10. A power tool according to claim 8, further comprising a spring arranged between the impact mechanism and the housing to absorb longitudinal vibration movements of the impact mechanism and to transfer to the impact mechanism forwardly directed feeding forces applied on the housing.

11. A power tool according to claim 8, wherein:

the impact mechanism is pneumatically powered and comprises a cylinder and a hammer piston, the housing has a pressure air supply passage, and said at least one resilient element is formed with an air feed passage connecting the pressure air supply passage in the housing to the impact mechanism.

12. A power tool according to claim 11, wherein:

the housing has a closed rear end and an opening at its forward end, the cylinder extends out through said opening leaving an annular clearance between the housing and the cylinder, and a bellows is provided to seal off said clearance and form a closed damping chamber in the housing through which exhaust air from the cylinder passes.

13. A power tool according to claim 7, wherein said at least one resilient element is located at the rear end of the impact mechanism.

14. A power tool according to claim 7, further comprising a spring arranged between the impact mechanism and the housing to absorb longitudinal vibration movements of the impact mechanism and to transfer to the impact mechanism forwardly directed feeding forces applied on the housing.

15. A power tool according to claim 7, wherein:

the impact mechanism is pneumatically powered and comprises a cylinder and a hammer piston, the housing has a pressure air supply passage, and said at least one resilient element is formed with an air feed passage connecting the pressure air supply passage in the housing to the impact mechanism.

16. A power tool according to claim 15, wherein:

the housing has a closed rear end and an opening at its forward end, the cylinder extends out through said opening leaving an annular clearance between the housing and the cylinder, and a bellows is provided to seal off said clearance and form a closed damping chamber in the housing through which exhaust air from the cylinder passes.

17. A power tool according to claim 1, wherein said at least one resilient element is located at the rear end of the impact mechanism.

18. A power tool according to claim 1, further comprising a spring arranged between the impact mechanism and the housing to absorb longitudinal vibration movements of the impact mechanism and to transfer to the impact mechanism forwardly directed feeding forces applied on the housing.

19. A power tool according to claim 1, wherein:

the impact mechanism is pneumatically powered and comprises a cylinder and a hammer piston, the housing has a pressure air supply passage, and said at least one resilient element is formed with an air feed passage connecting the pressure air supply passage in the housing to the impact mechanism.

20. A power tool according to claim 19, wherein:

the housing has a closed rear end and an opening at its forward end, the cylinder extends out through said opening leaving an annular clearance between the housing and the cylinder, and a bellows is provided to seal off said clearance and form a closed damping chamber in the housing through which exhaust air from the cylinder passes.

* * * * *